United States Patent [19]

Tompkins

[11] 4,273,193

[45] Jun. 16, 1981

[54] PROCESS FOR USE IN DEGASIFICATION OF SUBTERRANEAN MINERAL DEPOSITS

[75] Inventor: John C. Tompkins, Oklahoma City, Okla.

[73] Assignee: Kerr-McGee Coal Corporation, Oklahoma City, Okla.

[21] Appl. No.: 119,746

[22] Filed: Feb. 8, 1980

[51] Int. Cl.[3] ..... E21B 7/08; E21B 47/022; E21B 43/25

[52] U.S. Cl. ..... 166/314; 166/50; 175/45; 175/61; 175/62; 175/105

[58] Field of Search ..... 166/50, 271, 308; 174/47; 175/45, 50, 61, 62, 74, 104, 105

[56] References Cited

U.S. PATENT DOCUMENTS

| | | | |
|---|---|---|---|
| 3,823,787 | 7/1974 | Haworth et al. | 175/61 X |
| 3,934,649 | 1/1976 | Pasini et al. | 299/12 X |
| 4,043,395 | 8/1977 | Every et al. | 166/268 X |
| 4,051,456 | 9/1977 | Hellbecker et al. | 175/50 X |
| 4,143,721 | 3/1979 | Zuvela et al. | 175/45 |
| 4,153,120 | 5/1979 | Zuvela et al. | 175/45 X |

OTHER PUBLICATIONS

"Bits Make Methane Drainage Economical," Coal Age, Nov. 1978.

*Primary Examiner*—James A. Leppink
*Assistant Examiner*—George A. Suchfield
*Attorney, Agent, or Firm*—William G. Addison

[57] ABSTRACT

A process for drilling spaced horizontal boreholes in a coal or other mineral deposit in excess of 1500 feet in length in a pattern determined to maximize gas removal. Directional guidance is provided by a continuous downhole survey tool connected to data display devices by an internal drill rod cable system. Apparatus is provided to permit the passage of said cable system through the interior of a rotatable drill chuck assembly comprising a part of a drilling apparatus for drilling said boreholes. The apparatus supports the cable such that the cable is maintained in a substantially nonrotating position within the drill chuck assembly. Directional drilling control is provided by a positive displacement motor positioned at the end of the drill string and operated by a flow of drilling fluid through the drill string from the drilling rig. Upon completion of the borehole, the drill string is removed and gas which enters the borehole from the surrounding deposit is withdrawn.

4 Claims, 10 Drawing Figures

PROCESS FOR USE IN DEGASIFICATION OF SUBTERRANEAN MINERAL DEPOSITS

CROSS REFERENCE TO RELATED APPLICATIONS

This application relates to copending applications Ser. No. 119,744 entitled "Process For Degasification Of Subterranean Mineral Deposits" and Ser. No. 119,745 entitled "Borehole Survey Method And Apparatus For Drilling Substantially Horizontal Boreholes" filed of even date herewith.

BACKGROUND OF THE INVENTION

1. Field of the Invention

The present invention relates to a method of removing methane and other gases from subterranean coal deposits or other mineral deposits by horizontal drilling of degasification holes in said deposit.

2. Brief Description of the Prior Art

The inclusion of large quantities of methane in coal deposits long has been a safety problem in many areas of the world. The methane is tightly absorbed in the coal micropores and on the coal surfaces and is released during mining which creates a safety hazard.

There have been many attempts to overcome the problem of methane in coal deposits in the past. Early attempts to overcome the problem involved drilling a series of vertical vent holes in the deposit in the hope that the methane would flow from the coal deposit out of the vent holes. Controlled slant hole drilling through the overburden and into the coal deposit also has been attempted. More recent attempts have included such things as applying vacuum to the coal deposit to accelerate methane removal and the introduction of a displacing fluid such as a gas or water into the coal deposit to displace the methane.

U.S. Pat. No. 4,043,395 describes a method for removing methane from a coal deposit by injection of a carbon dioxide-containing fluid through an injection well extending into the coal deposit. The well then is shut in for a time sufficient to enable a substantial amount of absorbed methane to be desorbed into the injection fluid. The injection fluid with desorbed methane then is recovered from the injection well or separate wells spaced from the injection well. This process is repeated until the methane level in the coal is reduced to a level suitable for safe coal mining.

Most recently, with deeper mines being the current trend, that is mines 1250 feet to 2500 feet below the surface, horizontal boreholes drilled into a virgin coal deposit from a vertical entry shaft have become a viable method of draining methane from the coal deposit prior to mining development. Equipment and methods for drilling long holes in coal with reasonable directional control have been virtually nonexistent. Technology now permits the successful drilling of initial horizontal holes 500 to 1000 feet in length from the bottom of a coal mine ventilation shaft which is projected in advance of mine entry development. To date, this drilling has been performed with either specially constructed or modified rotary drills. While many survey instruments are available for determining the position of a borehole, they each require drilling to be discontinued and the survey tool to be pumped down the drill string to the position to be surveyed. The survey tool is removed by withdrawal of the drill string or by use of a wire line attached to the end of the survey tool. Survey instruments that are attached to the end of the drill string and that transmit data by cable previously have been considered unfeasible by those skilled in the art.

While all of the previous attempts have been successful in some degree, they have not been completely satisfactory due to the inadequate removal of methane or due to the excessive time required to carry out these processes. The rate of advance in working coal seams has been greatly increased with the advent of mechanization in underground mining and particularly long wall mining of coal deposits. The more rapidly advancing working face in the mining operation results in a constant release of methane from the coal due to the release of rock pressure and crack formations connected therewith. For this reason, in order to maintain adequate safety standards, operations periodically must be interrupted while steps are taken to maintain the concentration of methane gas below the permissible maximum. The interruption of the mining operation is undesirable for both technical and economic reasons.

To provide satisfactory drainage of the methane while permitting development to continue, substantially longer boreholes are required to degasify larger areas of the virgin coal. The present survey and drilling methods lack suitable accuracy to effect such degasification. It would be desirable to provide a process whereby methane could be removed from an area of an underground coal deposit prior to development of the mining entries thereinto while permitting mining to continue in other areas.

SUMMARY OF THE INVENTION

The present invention provides a process and various apparatus for drilling horizontal degasification holes in excess of 1500 feet in length to permit continuous methane or other gas removal from a coal deposit while mining development continues within the coal deposit.

The process includes the drilling of spaced horizontal boreholes in excess of 1500 feet in length in a pattern determined to maximize gas removal. A drilling rig having unique features is employed. Directional guidance for said drilling rig is provided by a downhole continuous survey tool connected to data display devices by an internal drill rod cable system. The survey tool and cable system are of a unique design. Directional drilling control is provided by a positive displacement motor used as a downhole drilling machine including a bent housing provided with a guidance ring to permit predetermined deviation in the borehole direction. Intermittant hydrofraction of the coal deposit surrounding the drill string is effected followed by additional drilling. Said hydrofraction is effected without the necessity of removing the drill string or survey instruments.

DESCRIPTION OF THE PREFERRED EMBODIMENTS

The process of the present invention can be used in the development of any underground coal or mineral deposit containing methane or other gases. The rate at which gas is removed from the coal deposit can be controlled by the number of degasification boreholes in any given area and their arrangement. For the purpose of illustration, and not by way of limitation, the process of the present invention will be described in relation to the degasification of methane from a coal deposit to permit excavation of air entries and return tunnels preparatory to long wall mining of the coal deposit.

Figure 1:
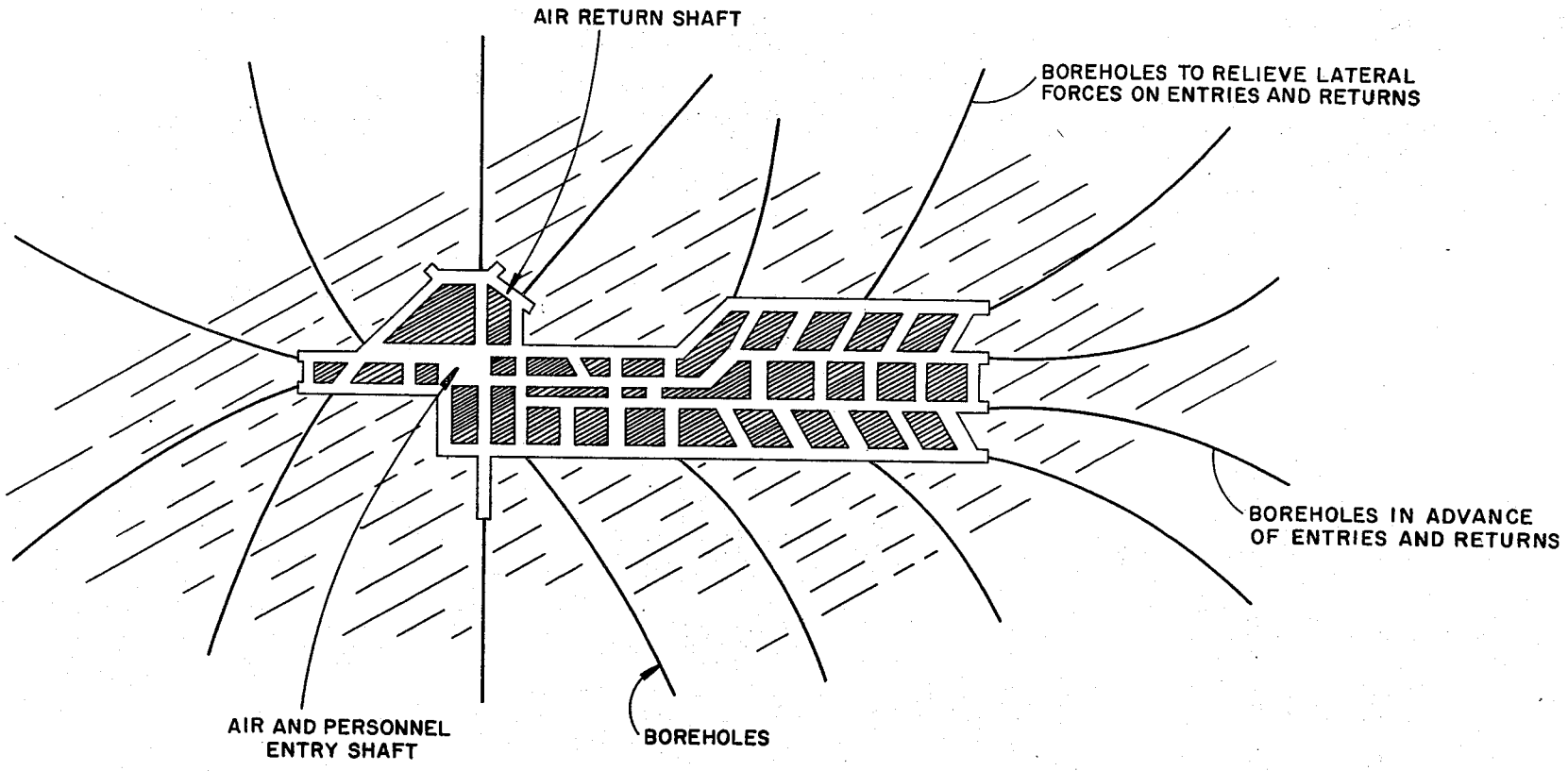
FIG. 1 is a drilling pattern for development of air entries and return tunnels in a coal mine.

Following location of a subterranean coal deposit containing quantities of methane or other gases, such as, carbon dioxide, a shaft is excavated to the depth of the deposit. To permit mining development of the deposit, horizontal boreholes in excess of 1500 feet and preferably about 2500 feet in length are drilled in a predetermined pattern within the confines of the coal deposit in the area in which development is to occur. Additional degasification boreholes also are drilled into the deposit in the area surrounding the shaft which presently is not to be developed. A drilling pattern that could be employed in the excavation and development of air entries and return tunnels is illustrated in FIG. 1.

The drilling relieves a substantial rock pressure in the coal deposit caused by the presence of the gas. During mining, the gas contained in the coal deposit has a tendency to drain to the ribs and face of the excavated tunnels. The substantial pressure exerted by the gas in the lateral direction as it moves through the deposit to the area of lower pressure formed by the mine tunnels often results in movement of the strata adjacent to the mine workings. Such movement causes rib or ceiling failures and consequent rock falls. The degasification boreholes provide a controlled drainage of methane gas from an area of the coal deposit prior to excavation to minimize the probability of undesirable rock falls and avoid the possibility of a gas explosion. The drainage can be continued for a sufficient time to reduce the gas concentration of the coal deposit to a level that is safe for mining. Typically, the gas concentration of the deposit can be reduced from about 50 to about 98 percent.

The degasification boreholes are drilled from a United States Bureau of Mines approved electrically operated drilling platform positioned within the mine shaft or developed entries. Generally, the drill is designed to provide a horizontal feed distance about 10 percent greater than the length of the sections of drill rod that are employed, to facilitate movement of the drill rods. In one particular embodiment, the drill was provided with an 11 foot long drill rod feed guide operatively associated with a drill chuck and appropriate drive means capable of appropriate chuck rotation for mechanically connecting and disconnecting the drill rods and for borehole reaming with drill rod rotation, if required.

Figure 2:
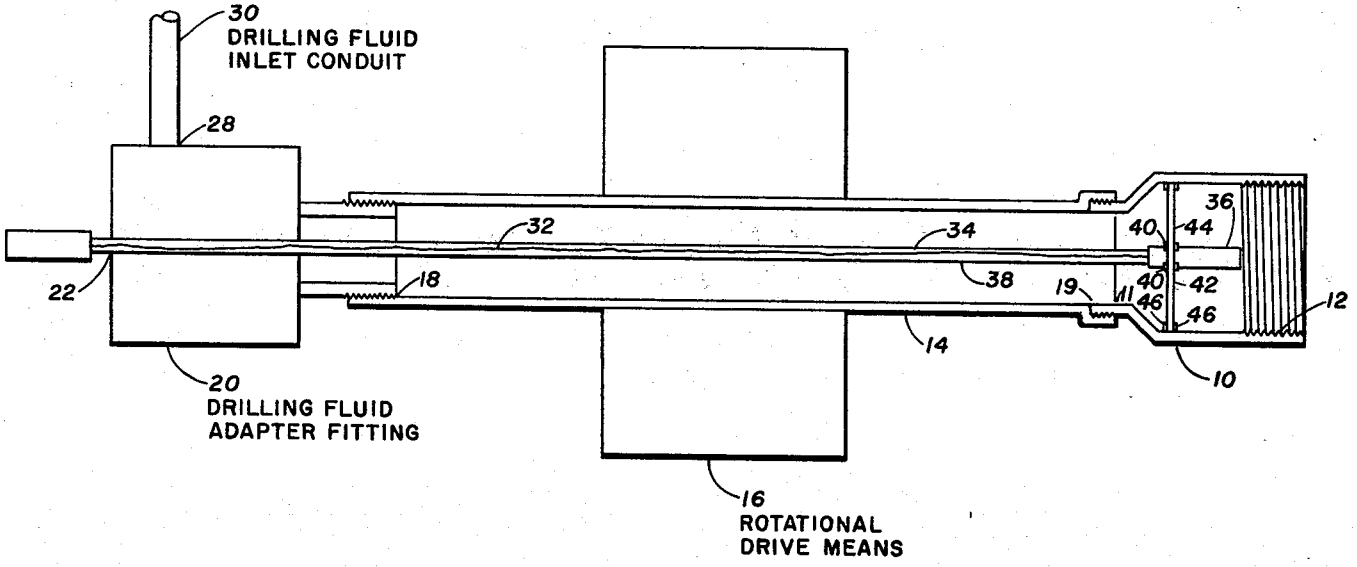
FIG. 2 is an illustration of a drill chuck assembly for use in a horizontal drilling platform.

Turning now to FIG. 2, an illustration of the drill chuck assembly is provided. The drill chuck assembly is movably attached to the feed guide to advance or retract a section of drill rod in relation to the borehole. The drill chuck assembly includes a hollow drive shaft 14 having threaded ends 18 and 19 and a drill chuck 10 that is connected to threaded end 19 of shaft 14. The drill chuck 10 is provided with a threaded end 11 to engage end 19 of shaft 14 and a threaded end 12 capable of sealably engaging the appropriately threaded end of a section of drill rod.

The drive shaft 14 passes through a rotational drive means 16 which provides rotational movement to shaft 14 for connecting and disconnecting drill rods. The threaded end 18 of shaft 14 is connected to an adapter fitting 20, comprising a drilling fluid swivel fitting. The drilling fluid adapter fitting 20 permits drilling fluid to be introduced into shaft 14 and the drill rods connected thereto while preventing leakage therefrom during any rotation of the shaft 14 in the drill chuck assembly. Drilling fluid is introduced into adapter fitting 20 through an opening 28 via a conduit 30 which is connected to a suitable pump (not shown), such as, for example, an electric driven triplex type pump of the type manufactured by Gaso Pump, Inc., Tulsa, Okla. which is capable of providing pressure of about 2000 psi.

The drill chuck assembly also is designed to permit a survey instrument signal cable 32 to pass through the interior of shaft 14 in such a manner that the cable 32 substantially is not twisted by rotation of the shaft 14. The cable 32 is supported within the drill chuck assembly by a support assembly 34. Support assembly 34 extends through the interior of drill chuck 10, the central interior portion of shaft 14 and the interior of adapter fitting 20. The cable exits adapter fitting 20 at a site designated by reference number 22, and terminates at a power source and data display devices (not shown).

Figure 3:
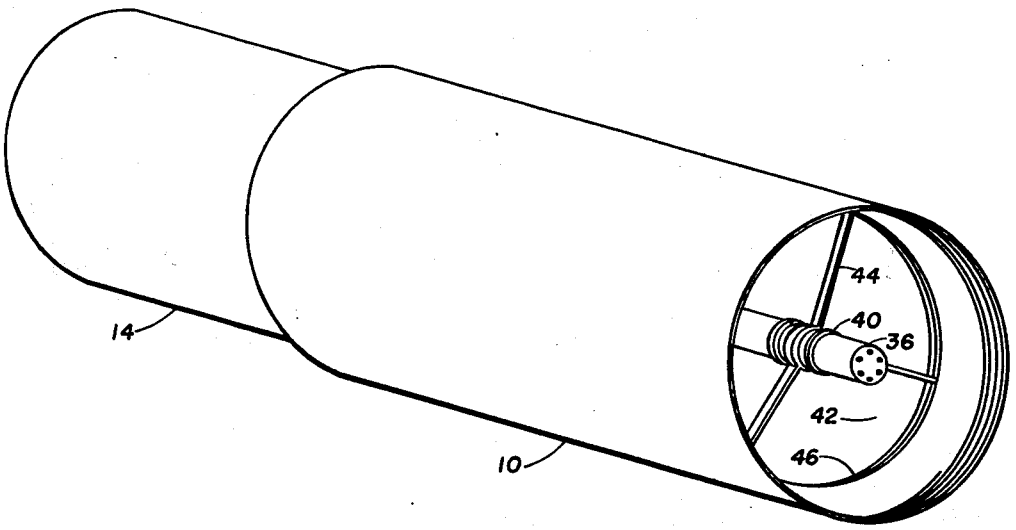
FIG. 3 is an illustration of a electrical cable support means for use in the drill chuck assembly.

As shown in FIGS. 2 and 3, the support assembly 34 comprises a submarine cable connector 36 attached to the wire leads of cable 32 which extends through a hollow cable support rod 38 to which connector 36 is fixedly attached, locking rings 40 and a rotating support assembly 42 including a rotating support 44. The rotating support 44 comprises a framework of radiating support arms that is positioned upon the exterior surface of submarine cable connector 36 and retained against undesirable horizontal movement by the locking rings 40. A second pair of locking rings 46 are positioned within the interior of drill chuck 10. The locking rings 40 and 46 are maintained in position by frictional and expansional forces. Advantageously, a pair of circular indentations or grooves are present upon the exterior surface of cable connector 36 to facilitate positioning of the locking rings on either side of the rotating support 44. Similar indentations or grooves within the interior of drill chuck 10 facilitate the positioning of locking rings 46.

While the rotating support 44 is illustrated with three radiating support arms, which provide optimal support with the minimum of surface area, it is to be understood that rotating support 44 may have four or more radiating support arms. The additional support arms are undesirable in that they decrease the cross-sectional area available for drilling fluid flow within drill chuck 10 and increase the drag upon the fluid reducing its effective flow rate for use in operating the drill motor to be hereinafter described. Support assembly 34 may comprise any materials that provide suitable corrosion resistance within the drilling fluid environment present in the drill chuck assembly, such as, stainless steel.

In an alternate embodiment, drill chuck 10 can comprise two individual sections which are threaded together to form the entire chuck (not illustrated). One section of drill chuck 10 is provided with threads 12. It has been found that threads 12 can wear sufficiently during continual operation of the drilling platform that leakage of drilling fluid around the joint created by threads 12 and the end of a drill rod can not be prevented. When this occurs, the two-piece design of chuck 10 permits the section containing threads 12 to be replaced with a new section without requiring further disassembly of the drilling platform to effect the repairs. The rotating support 44 is mounted in the other section of drill chuck 10. In this instance, rotating support 44 is attached to that section of drill chuck 10 by welds instead of locking rings 46. This fixedly attaches the radiating support arms of rotating support 44 to the drill chuck while still permiting the support to rotate about connector 36 to prevent the instrument signal cable 32 from being twisted by rotation of shaft 14 and drill chuck 10.

The drilling platform also is provided with means to assist in moving the drill rods into position on the drill rod feed guide or from the feed guide during retraction. As is well known by those skilled in the art, such means can conventionally comprise, for example, a hydraulically operated hoist. The drilling platform can comprise any apparatus that generally provides the features described hereinbefore and that is capable of operating with the drill chuck assembly illustrated in FIG. 2.

In preparation for the long hole drilling, an initial borehole is started to prepare for the installation of a permanent casing which will protect the strata adjacent the tunnel face from fracturing when closed-in well pressure is applied to the exposed end portion of the long horizontal borehole.

In one particular embodiment, an initial 40 foot borehole is drilled using a 3½ inch diameter diamond drag bit on a positive displacement motor, such as, for example, a Dyna-Drill manufactured by Dyna-Drill Company, Long Beach, Calif., which is used as a downhole drilling machine. The first 10 feet of the borehole then is reamed to receive a temporary 6 inch diameter packer of a polyethylene plastic which is provided with a vertical riser and drop line at the entry of the borehole. Thus, it is possible to separately remove methane thru the riser and drilling fluid and associated cuttings thru the drop line. The temporary packer also may comprise any other suitable material, such as, for example, polyvinylchloride pipe. The temporary packer is manually sealed in the borehole using a packing material, such as, for example, brattice cloth. Drilling then is resumed with a survey instrument now connected in the drill string behind the Dyna-Drill. The survey instrument permits accurate directional control as drilling continues.

Figure 4:
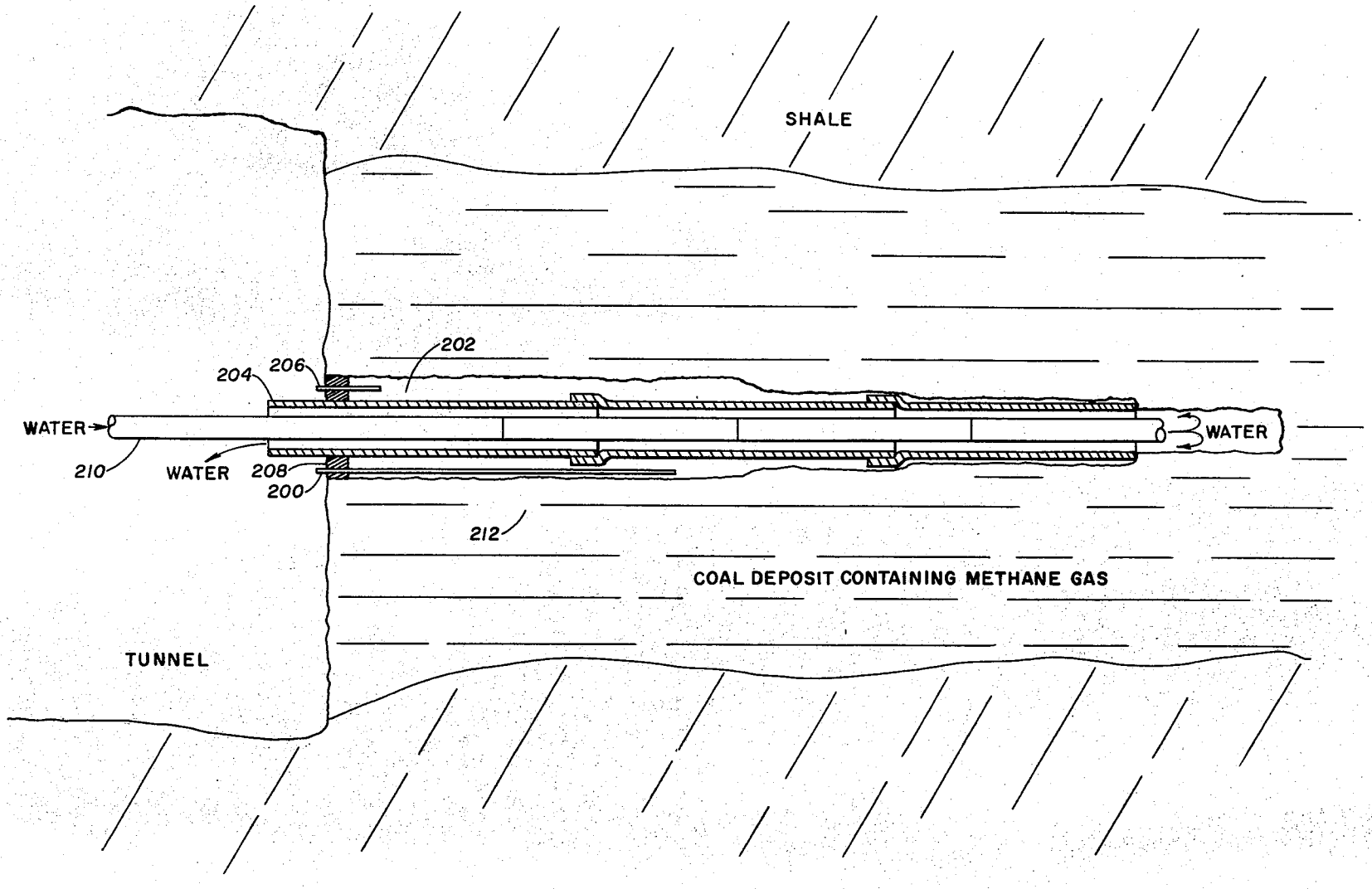
FIG. 4 is an illustration of a borehole that is prepared for grouting of the permanent casing.

The necessary length of permanent casing is dependent upon the physical characteristics of the coal deposit; longer casings being required for highly faulted and friable coal deposits than for denser deposits which would tend to inhibit lateral flow of gas from the surrounding strata into the shaft from which drilling is performed. The diameter of the permanent casing will depend upon the diameter of the drill bit that is used to drill the borehole. The borehole is drilled to a length slightly greater than the desired length of permanent casing. The borehole then is reamed preparatory for installation of a 4 inch diameter permanent casing. The temporary packer is removed and a 4 inch diameter polyethylene casing having a 10 foot section of steel pipe attached to its outby end is inserted into the borehole to the full reamed distance. The casing then is grouted in place by known conventional methods. Thus, as shown in FIG. 4, in grouting the casing, a 1 inch diameter pipe 200 (approximately 12 feet in length) is inserted into the annulus of borehole 202 in a coal deposit 212 parallel to a casing 204. Further, a short ½ inch diameter nipple 206 (approximately 1 foot in length) is inserted into the annulus at a position above casing 204 at the opening of borehole 202. The pipe 200 and nipple 206 are held in place with packing 208, such as, brattice cloth to temporarily seal the annulus and limit the outward flow of grout. The grout, comprising, for example, about 50 percent portland cement and 50 percent water by weight, is pumped into the annulus surrounding casting 204 through pipe 200. Sufficient grout is introduced to completely fill the annulus. To insure the elimination of any air pockets within the annulus, grout is pumped into the annulus until the grout flows freely from the nipple 206. Prior to starting the grouting, a drill string 210 is inserted into the casing 204 for its total length and water is passed through the drill string 210 and back out on the outside of the drill string 210 within the casing 204 to wet the inside of the casing to prevent grout from sticking thereto. When grouting is completed, the casing 204 is flushed with additional water to ensure complete removal of the excess grout.

After the grouting has set about the casing, a gate valve capable of permitting the passage of the drill rods and bit there through is attached to the steel pipe installed on the outby end of the casing. The gate valve may comprise any of those commercially available. An adjustable packer assembly then is attached to the gate valve to permit a separation of any gas produced during the drilling operations from the drilling fluid and drill cuttings. The construction and operation of such devices is well known by those skilled in the art.

Thereafter, the bit and drill motor are introduced into the borehole followed by a section of drill rod containing a survey instrument, a section of beryllium copper drill rod or the like and a sufficient quantity of steel drill rods to advance the bit to the end of the borehole. The beryllium copper drill rod is interposed in the drill string between the survey instrument and the steel drill rods to alleviate any magnetic effects which might be caused by the steel drill rods upon the measurements recorded by the survey instrument. The drill string then is ready to continue drilling of the borehole to the desired final length.

As is known by those skilled in the art, with this type of drill motor, the drill rods do not rotate within the borehole to drive the drill bit, but are used merely as a drill fluid conduit. Thus, drilling fluid is pumped through the interior of the drill rods under pressure into the drill motor wherein it is directed through a cavity between a rotor and a stator contained therein to drive the motor. The hydrostatic energy of the drilling fluid is transferred to the drill bit by rotation of the rotor which is connected by a connecting rod and drive shaft to the drill bit.

During drilling operations, the drill bit contacts rock strata of varing hardness. In the absence of any change in work output of the drill motor, the speed of rotation of the drill bit will decrease when contacting harder rock and the bit can no longer cut through the rock. To drill through harder rock, more energy must be supplied to the drill motor to effect drill bit rotation. The energy necessary to increase the work output of the drill motor is supplied by increasing the hydrostatic pressure of the drilling fluid supplied to the drill motor.

After the drilling fluid passes through the drill motor, it is discharged adjacent to or through the drill bit to remove rock cuttings from the face of the bit. The quantity of drilling fluid which passes through the drill motor often is insufficient to adequately remove the rock cuttings.

Figure 5:
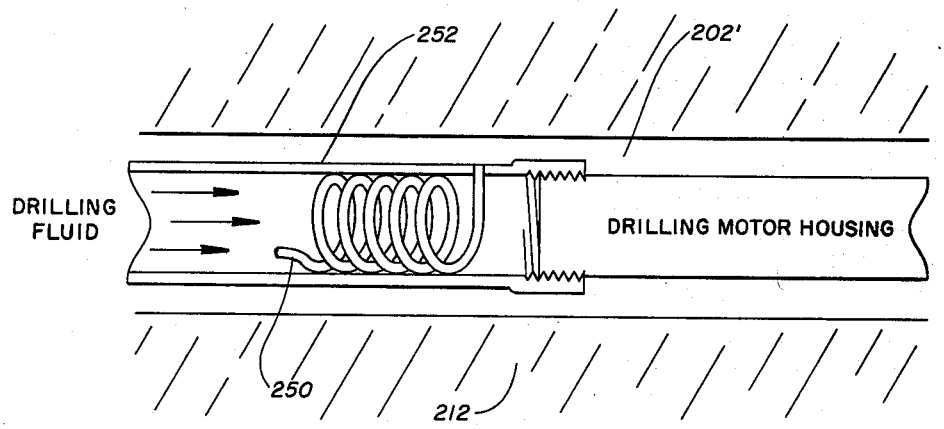
FIG. 5 is an illustration of a drilling fluid by-pass circuit for use in the process of the present invention.

Turning now to FIG. 5, to ensure that sufficient drilling fluid is present within the borehole to remove rock cuttings from the region of the drill bit produced during the drilling operation and that a substantially constant volumetric flow of drilling fluid of adequate pressure to operate the drill motor is maintained, a drilling fluid by-pass circuit is installed within the drill rod segment immediately adjacent to the drill motor. The by-pass circuit comprises a helically shaped coil of metal tubing 250 within the interior of a drill rod segment 252 which permits drilling fluid within the drill rod 252 to exit therefrom into the borehole 202' in the deposit 212' after having passed through said coil but without passage through the drill motor. The length and diameter of the coil as well as the diameter of the tubing is selected to permit the by-pass circuit to maintain a substantially uniform rate of drilling fluid discharge regardless of the hydrostatic pressure of the fluid. It has been found that the by-pass circuit can maintain the discharge rate within 15 percent of a desired rate during a change in drilling fluid pressure of about 1000 psig. Normally, the change in discharge rate will by less than 5 percent for a change in drilling fluid pressure of about 500 psig. or less. Such discharge rate regulation ensures that sufficient drilling fluid enters the drill motor to effect proper operation. If, for example, an orifice was employed to effect the discharge, rather than the helically shaped coil of the present invention, an increase in the hydrostatic pressure of the drilling fluid would result in a substantial increase in the discharge rate through the orifice and either substantially no change or a decrease in the work output of the drill motor.

The positioning of the helical coil about the interior surface of the drill rod minimizes the drag forces exerted upon that portion of the drilling fluid which is introduced into the drill motor to provide motive power to the drill bit.

The drill bit preferably is a diamond tipped drag bit such as manufactured by Christensen Diamond Products, USA, Salt Lake City, Utah in which a thin layer of synthetic diamond material is attached to the face of the bit. Preferably, fluid ports are provided on the face of the bit to facilitate flushing of the cuttings from the face of the drill bit with the drilling fluid.

Figure 6:
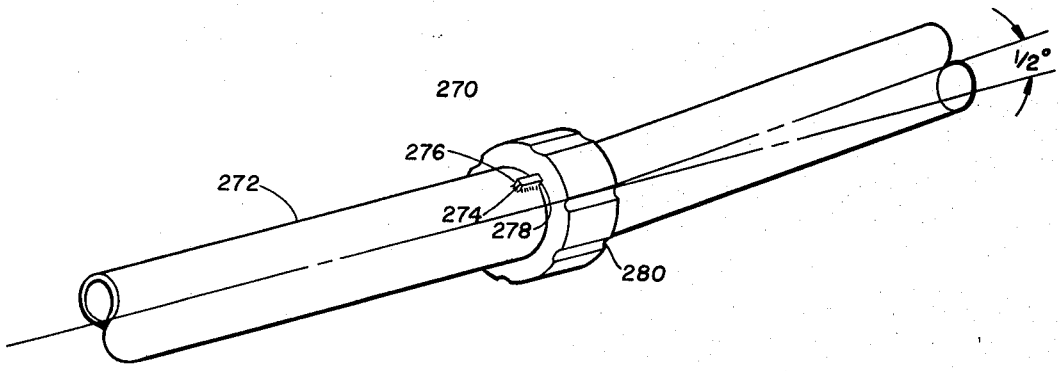
FIG. 6 is an illustration of a guidance ring for use in directing the direction of travel of a drill bit in the process of the present invention.

Turning now to FIG. 6, the drill motor is provided with a circular guidance ring 270 supported about a drill motor housing 272 at a position immediately behind that at which a bend from the center line of the drill is formed in the housing. The bend permits a controlled change to be made in the directional heading of the drill bit as successive drill rods are introduced into the borehole. The particular angle of the bend formed in the housing can vary. The selection of a particular angle for the bend will depend upon the rock strata that is to be drilled through and its selection is well within the skill in the art. The guidance ring 270 is sized to permit more efficient control of the direction of travel of the drill bit. The guidance ring is able to accomplish directional control through action as a wedge through guidance positions in which the direction of travel of the drill bit is upwards or sideways and both as a wedge and a limiting fulcrum through positions in which the direction of travel of the drill bit is downward within the coal deposit. The diameter of the guidance ring 270 should be at least about 10 percent greater than the diameter of the drill motor housing 272. The guidring 270 is maintained in position by a metal key 274 that is spot welded or the like into a keyway 276 formed in the housing 272 and a matching keyway 278 is ring 270. To ensure that rock cuttings do not settle within the borehole in advance of the ring 270 and thereby hinder its advance in the borehole or otherwise cause it to be deflected from its proper position, channels 280 are formed about the circumference of the ring 270. The specific configuration of the channels 280 can vary so long as sufficient cross-sectional area has been removed to permit the flow of rock cuttings between the ring 270 and the surface of the borehole when they are in contact.

In one embodiment, in which the drill motor housing had a 0 degree 30 minute bend, it was possible to guide the course of the drill bit through a vertical change of from about 0 degees 6 minutes to about 1 degree 30 minutes and horizontal rates of change of from about 0 degrees 6 minutes to about 0 degrees 30 minutes per section of drill rod having a 10 foot length. Such guidance capability permits accurate drilling of a long hole along a projected pathway.

The ability to turn the course of the drill bit also permits "branching" to be accomplished in a borehole. Branching is effected by retracting a portion of the drill rod until the drill bit is positioned at the desired location for the branch hole and then turning the direction of travel of the drill bit by appropriate guidance. Such a procedure also permits location of the roof or floor of a coal deposit to guide the borehole within the vertical boundaries of the coal deposit.

The continuous survey instrument which permits guidance of the drill bit is supported within a fluid-tight compartment in a section of drill rod adjacent the drill motor. The survey instrument measures the azimuth, dip and roll angle of the drill bit. The azimuth and dip of the drill bit are combined with the distance of instrument advance in the borehole to calculate the position of the bit. The position of the drill bit is charted on a topographical map of the coal deposit when each new section of drill rod is added to advance the bit.

The term "continuous survey instrument" as used herein means a device capable of transmitting various data relative to the position of the drill bit within the borehole either by constant electrical signals or intermittent signals which are supplied upon a demand for data and which are updated between each signal transmission. A description of such a device is set forth in the co-pending application entitled "Borehole Survey Method And Apparatus For Drilling Substantially Horizontal Boreholes," referred to before, and the entire disclosure contained in that application specifically is incorporated herein by reference.

In a preferred embodiment, the data transmitted by the survey instrument is introduced into a computer which performs the necessary calculations and automatically plots the position of the borehole at any time during the drilling operation to facilitate drilling guidance.

The roll angle is employed to provide guidance to the drill bit. Initially, the survey instrument and drill motor are inserted into the borehole opening at a roll angle reading of 0 degrees. The position of the drill bit then is guided by rotation of the drill in a clockwise manner for a specific number of degrees to attain a change in direction or deflection of the path of the drill bit through the use of the bent housing and guidance ring of the drill motor. Table 1, below, provides a list of roll angles required to accomplish a designated change in direction of the drill bit with the bent housing of the described drill motor initially arranged with a 0 degree 30 minute upward inclination corresponding to a roll angle of 0 degrees.

TABLE I

| Rotation Position, degrees | Change in elevation in degrees per 10 feet of distance | Relative direction of travel |
|---|---|---|
| 0 | 0.26 | upward |
| 10 | 0.23 | |
| 20 | 0.21 | upward to the right |
| 30 | 0.17 | |
| 40 | 0.11 | |
| 50 | 0.05 | |
| 60 | 0.00 | right |
| 70 | 0.10 | |
| 80 | 0.18 | |
| 90 | 0.20 | |
| 100 | 0.26 | |
| 110 | 0.29 | downward to the right |
| 120 | 0.32 | |
| 130 | 0.37 | |
| 140 | 0.40 | |
| 150 | 0.42 | |
| 160 | 0.44 | |
| 170 | 0.46 | |
| 180 | 0.47 | downward |
| 190 | 0.46 | |
| 200 | 0.44 | |
| 210 | 0.42 | |
| 220 | 0.40 | |
| 230 | 0.37 | |
| 240 | 0.32 | downward to the left |
| 250 | 0.29 | |
| 260 | 0.26 | |
| 270 | 0.20 | |
| 280 | 0.18 | |
| 290 | 0.10 | |
| 300 | 0.00 | left |
| 310 | 0.05 | |
| 320 | 0.11 | upward to the left |
| 330 | 0.17 | |
| 340 | 0.21 | |
| 350 | 0.23 | |

Survey instrument data is transmitted from the survey instrument to the drilling platform or any other desired location outside the borehole by a cable positioned within the drill string. The cable is of the type referred to by those skilled in the art as submarine cable. The cable is capable of complete submersion in the drilling fluid without damage. Previously, those skilled in the art have not employed survey instruments positioned near the drill bit which continuously transmit data by cable during the drilling operation due to an inability to prevent the cable from twisting and breaking within the drill string. One aspect of the present invention provides a unique method of introducing the cable into the drill rods of the drill string such that it does not twist and break during drilling operations. The cable is installed within the drill string in segments of predetermined length. In one embodiment, the cable is installed in 105 foot lengths which are connected to one another by suitable submersible connection means such as those described as interlocking male and female submarine connectors.

Figure 7:
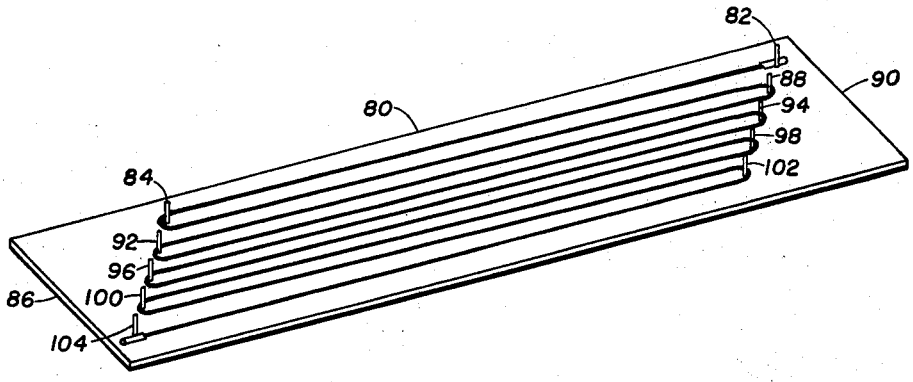
FIG. 7 is an illustration of a template for winding the cable for installation within the drill rod.

To install the cable within the drill string, the cable first is wound about a template 80, as illustrated in FIG. 7. The cable is positioned upon template 80 such that the male submarine connector is positioned at an end 90 of template 80 by an outermost support pin 82. The cable then is formed about a pin 84 located at an end 86 of template 80 to form a loop. A second loop then is formed about a pin 88 located at end 90 of template 80. The procedure is repeated until the cable is formed into a series of loops about the remaining support pins 92, 94, 96, 98, 100, 102 and the female submarine connector is positioned by a pin 104. The position of the various pins upon template 80 are such that the maximum length of a loop of the cable is less than the length of a section of drill rod. Preferably, the pins are positioned upon the template 80 such that the loops which are formed are of substantially the same length.

Thus, the cable is formed into a series of substantially uniform longitudinal loops comprising substantially straight lengths of cable which are connected together by arcs of cable having a small radius. The loops are positioned such that the series of arcs connecting the straight lengths of cable are progressively offset in the longitudinal direction of the loops.

The cable then is removed from the template 80 as a bundle by gathering together the loops near one end of template 80. The bundle is inserted into a single drill rod segment with the male submarine connector of the cable positioned near the male or exterior threaded end of the drill rod. The insertion can be performed by any method which accomplishes the desired installation.

Figure 8:
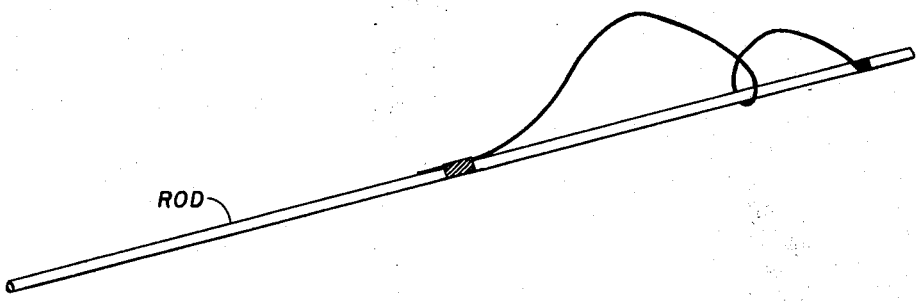
FIG. 8 is an illustration of apparatus for installing the cable bundle within the drill rod.
Figure 9:
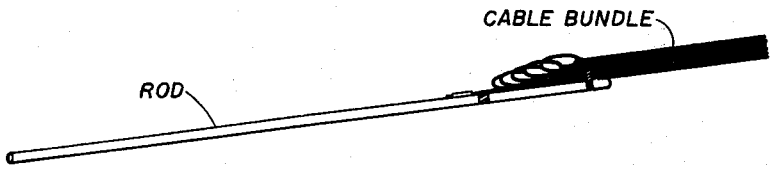
FIG. 9 is an illustration of a cable bundle attached to the installation apparatus.

In one embodiment, the cable is removed from one end of the template 80 and is tied with a line near the end in a releasable manner, such as with a strap attached to the end of an 11 foot long rod as illustrated in FIGS. 8 and 9. The rod then is passed through the interior of the drill rod in the appropriate direction and the cable is drawn into the interior of the drill rod by pulling the rod. When the cable is completely within the interior of the drill rod and the male and female connectors are positioned at the male and female ends of the drill rod, respectively, the strap is released and the rod is separated from the cable. In some instances, it may be desirable to apply a lubricant to the opening into which the cable bundle is drawn to facilitate passage of the cable.

The particular length of 105 feet for the section of cable is selected to provide a void space within the cross-section of the interior of the drill rod of at least about 50 percent. In this particular instance, the drill rod is 2 7/8 inch diameter NXB drill steel, in lengths of 10 feet. The void space within the drill rod is necessary to minimize interference by the cable system with the flow of drilling fluid through the interior of the drill string.

The drill rods which form the drill string are oriented within the drill hole such that the male end of the drill rod extends toward the open end of the borehole at which the drilling platform is located. When a section of drill rod containing the cable bundle is to be inserted into the string of drill rods, the section is positioned on the drilling platform and the female submarine connector is attached to the male connector at the end of the drill pipe that previously has been inserted into the borehole. The male submarine connector on the other end of the cable bundle is attached to the female connector positioned within the end of the drill chuck 10 illustrated in FIG. 3. The section of drill rod then is inserted into the borehole by the drilling platform as drilling continues and a new section of drill rod is prepared for installation. To install the next section of drill rod, the male connector is disconnected from the female submarine connector within the drill chuck 10 (FIG. 3) and additional cable is pulled from the end of the cable-loaded drill rod for a distance sufficient to pass through the new section of drill rod. The cable is drawn through the new section of drill rod by any suitable means, such as, for example, by the rod employed to initially load the cable bundle within the drill rod and reconnected to the survey instrument data display through the female submarine connector within the drill chuck. The new section of drill rod then is installed and the process is repeated until nine sections of the 10 foot drill rod have been installed in addition to the cable-loaded section. Thereafter, a new section of cable-loaded drill rod is installed and the process is repeated. The novel arrangement of the cable within the drill rod permits the cable to be withdrawn from the drill rod without snagging or otherwise interferring with the cable remaining within the loaded drill rod and also permits an uninterrupted flow of drilling fluid to the drill motor.

Figure 10:
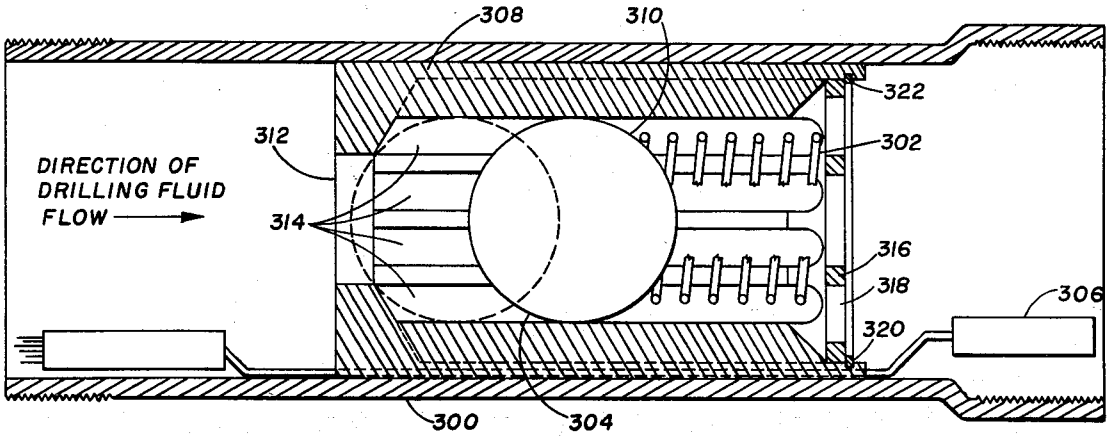
FIG. 10 is an illustration of a check valve sub for use in preventing reverse flow of drilling fluid.

Turning now to FIG. 10, to limit reverse flow of the drilling fluid from the drill string when the string is broken to insert additional drill rods, a ball stop check valve sub is placed in the drill string at about 200 foot intervals. The check valve sub 300 is a section of drill rod approximately one foot in length that is provided with appropriate threads for connection to the male and female ends of the 10 foot drill rods. The check valve sub 300 includes a compression spring 302 and ball valve assembly 304 and an electrical coupling 306 for connecting the ends of the submarine cable contained in the sections of drill rod on each side of the sub. The ball valve assembly 304 comprises a valve body 308 having an opening at an end 312 smaller than the diameter of a metal ball 310 which functions to seal against the opening and prevent reverse flow of drilling fluid. When drilling fluid is introduced into end 312 of valve body 308 the ball 310 moves away from the opening and presses against spring 302. The drilling fluid flows around ball 310 through grooves 314 contained in body 308 and passes through openings 318 in a plate 316. Plate 316 retains the compression spring 302 inside body 308. The plate 316 is held in position by a retaining ring 320 which fits in a groove 322 in body 308. The check valve sub permits the drilling fluid that has passed through the valve to flow only in the direction of the drill motor. When fluid flow stops, compression spring 302 returns ball 310 against end 312 of body 308 to seal the opening and limit fluid passage back through the valve.

To facilitate degasification via the borehole drilled in the coal deposit, the coal surrounding the borehole is periodically hydrofractured during the drilling process. The hydrofracturing is accomplished without the necessity of removing the drill string from the borehole. The frequency of the fracturing operation and the hydrostatic pressure necessary for fracturing will depend upon the structure of the coal deposit. The determination of appropriate frequency and pressure is well within the skill of an experienced artisan. In one embodiment, two pressure actuated packers, such as, for example, those produced by Halliburton Company, Duncan, Oklahoma are positioned at 100 foot intervals on the drill string behind the drill motor. The packers are actuated when the drilling fluid pressure, as measured by a pressure regulator attached to one of the packers, attains a 60 second constant pressure of about 600 psi. The packers expand within the annulus of the borehole at a pressure of from about 1.3 to about 2 times the drilling fluid pressure to seal off the annulus. To actuate the packers, the drill bit attached to the drill motor is advanced to the face of the hole and a slight forward pressure is applied to retard further rotation of the bit and effectively stall the drill motor. The drilling fluid then is forced to flow only through a volumetric controlled bypass line located in the drill rod behind the drill motor in the drill string. The drilling fluid pressure then is increased to about 800 psi. within the forward portion of the long hole to fracture the coal deposit in that region. Thereafter, the drilling fluid pressure is reduced, the packers are permitted to retract and drilling is resumed for an additional 200 feet at which time the hydrofracturing is repeated.

The drilling fluid that is employed in the process of this invention can comprise water or any other fluid, including any chemicals which may be admixed with the fluid to enhance its usefullness in the apparatus, such as, for example, rust inhibitors or in removing rock cuttings from the borehole, such as, for example, fluid density controllers.

Following completion of the borehole to the desired distance of from about 1500 to 3000 feet or more, the drill string is removed from the hole, the adjustable packer and gate valve are removed from the end of the casing and a gas regulating manifold system is attached to the end of the hole casing. The manifold system provides for the separation of solids and water from the discharged gas, metering of the gas and gas flow pressure control when the gas enters a gas collector line that also is connected to the manifold system. The gas collector line may be connected to several boreholes to collect the discharged gas for transport to the surface from the subterranean coal deposit. The manifold system and gas collector line are provided with a pressure sensitive monitoring system that is connected to a series of automatic safety shutoff valves that close off the flow of gas over the full length of the gas piping system in the event of any damage to the gas collector line or any overpressure within the system.

While the present invention has been described with respect to what at present is considered to be the preferred embodiment thereof, it is to be understood that changes or modifications can be made in the disclosed process without departing from the spirit or scope of the invention as defined by the following claims.

What is claimed is:

1. A process for removing gases from a subterranean mineral deposit comprising:

providing a drilling apparatus capable of producing horizontal boreholes within the subterranean deposit;

positioning said drilling apparatus within a passage within said deposit to drill a horizontal borehole in a predetermined position to effect gas removal from said deposit;

drilling a horizontal borehole by advancing a rotating drill bit from said drilling apparatus by connecting a plurality of segments of drill rod to the end of said drill bit to form a drill string while applying horizontal force produced by the drilling apparatus to the segment of drill rod nearest said drilling apparatus, said horizontal force being translated through the drill string comprising the plurality of drill rods to advance said drill bit;

providing directional guidance for said drilling through use of a continuous survey instrument positioned near the end of said drill string connected to said drill bit, said survey instrument being connected to data display devices positioned outside the borehole by an internal drill rod cable system passing through the interior of said drill string;

providing said drilling apparatus with a drilling chuck assembly which includes a rotatable drill chuck, a hollow drive shaft, operatively associated with a rotational means, said drive shaft being interposed between and connected to said drill chuck, a stationary drilling fluid adaptor fitting for introducing drilling fluid into said drill string connected to said drilling apparatus and a hollow cable support rod which extends through the interior of said rotatable drill chuck, hollow drive shaft and stationary drilling fluid adaptor fitting, said support rod having a rotating support positioned upon that end of the support rod which is within the interior of the drill chuck, said rotating support being capable of rotation with the rotation of the drill chuck while maintaining the support rod in a fixed, non-rotating position to permit said cable connecting said survey instrument to said data display devices to pass through the interior of said hollow cable support rod without being subjected to substantial rotation during rotation of said drill chuck;

withdrawing said drill string including said survey instrument and said drill bit from the borehole upon completion of drilling to a predetermined depth; and withdrawing gas which flows into said borehole from the surrounding mineral deposit from said borehole.

2. The process of claim 1 wherein the rotating support comprises a framework including at least three radiating support arms that project substantially from the region in which the support rod is located to the surface of the interior of the drill chuck.

3. A process for removing gases from a subterranean mineral deposit comprising:

providing a drilling apparatus capable of producing horizontal boreholes within the subterranean deposit;

positioning said apparatus within a passage within said deposit to drill a horizontal borehole in a predetermined position to achieve gas removal from said deposit;

drilling said borehole to a predetermined depth employing a continuous survey instrument to provide directional guidance, said survey instrument being positioned near the end of a drill string projecting from said drilling apparatus and being connected to data display devices positioned outside the borehole by an internal drill rod cable system passing through the interior of said drill string, said cable system comprising a series of cable segments of predetermined length sequentially connected together within said drill string;

providing said drilling apparatus with a drilling chuck assembly which includes a rotatable drill chuck, a hollow drive shaft which is operatively associated with a rotational means and which is interposed between and connected to said drill chuck, a stationary drilling fluid adaptor fitting for introducing drilling fluid into said drill string connected to said drill chuck and a hollow cable support rod which extends through the interior of said rotatable drill chuck, hollow drive shaft and stationary drilling fluid adaptor fitting, said support rod having a rotating support positioned upon the end of said support rod which is positioned within the interior of the rotatable drill chuck, said rotating support being capable of rotation with the rotation of the drill chuck while maintaining the support rod in a fixed, non-rotating position to permit the cable connecting said survey instrument to said data display devices to pass through the interior of said hollow cable support rod without being subjected to substantial rotation during rotation of said drill chuck;

withdrawing said drill string including said survey instrument and said drill bit from the borehole upon completion of drilling to the predetermined depth; and withdrawing gas which flows into said borehole from the surrounding mineral deposit from said borehole.

4. The process of claim 3 wherein said rotating support comprises a framework including at least three radiating support arms that project substantially from the region in which the support rod is located to the surface of the interior of the drill chuck.

* * * * *